US007416253B2

(12) United States Patent
Kim

(10) Patent No.: US 7,416,253 B2
(45) Date of Patent: Aug. 26, 2008

(54) SEAT APPARATUS HAVING VARIABLE GAP

(76) Inventor: Sun Whan Kim, 23-1 Burim-dong, Kwacheon-si, Kyoungki-do 427-050 (KR)

( * ) Notice: Subject to any disclaimer, the term of this patent is extended or adjusted under 35 U.S.C. 154(b) by 350 days.

(21) Appl. No.: 10/560,031

(22) PCT Filed: Jun. 11, 2004

(86) PCT No.: PCT/KR2004/001404

§ 371 (c)(1),
(2), (4) Date: Dec. 8, 2005

(87) PCT Pub. No.: WO2004/110218

PCT Pub. Date: Dec. 23, 2004

(65) Prior Publication Data

US 2006/0152053 A1 Jul. 13, 2006

(30) Foreign Application Priority Data

Jun. 12, 2003 (KR) ..... 10-2003-0038059

(51) Int. Cl.
*A47C 1/00* (2006.01)
*B62J 1/00* (2006.01)

(52) U.S. Cl. ..... 297/312; 297/201

(58) Field of Classification Search ..... 297/312, 297/201, 284.3, 314, 202, 232, 233, 249
See application file for complete search history.

(56) References Cited

U.S. PATENT DOCUMENTS

| | | | | | |
|---|---|---|---|---|---|
| 595,434 | A * | 12/1897 | Burge | ..... | 297/201 |
| 694,875 | A * | 3/1902 | Meighan | ..... | 297/201 |
| 1,976,326 | A * | 10/1934 | Carlton | ..... | 297/312 |
| 4,877,286 | A * | 10/1989 | Hobson et al. | ..... | 297/215.13 |
| 5,024,485 | A * | 6/1991 | Berg et al. | ..... | 297/312 |
| 5,713,632 | A * | 2/1998 | Su | ..... | 297/312 |
| 6,095,600 | A * | 8/2000 | Mattingly | ..... | 297/201 |
| 6,290,291 | B1 * | 9/2001 | Kojima | ..... | 297/201 |
| 6,761,400 | B2 * | 7/2004 | Hobson | ..... | 297/201 |
| 6,893,090 | B1 * | 5/2005 | Van Deursen et al. | ..... | 297/312 |
| 7,090,303 | B2 * | 8/2006 | Kropa | ..... | 297/466 |

* cited by examiner

*Primary Examiner*—David R Dunn
*Assistant Examiner*—Tania Abraham
(74) *Attorney, Agent, or Firm*—Rosenberg, Klein & Lee

(57) ABSTRACT

A seat apparatus provides a pair of separate seat units which is conveniently adjustable to fit according to the user's body shape. The device is comprised of: a pair of seats that can move in the opposite directions; a pair of moving plates attached under the seats that enables the movement of the seats; a base supporting the moving plates for the movement in the opposite directions; a shaft on the upper side of the base that is attached to rotate; a cylindrical shaped gap controller attached in the middle of the shaft with a pair of guidance grooves that have one narrow end and the other wide end; a motoring device attached on one end of the shaft to rotate the shaft; a pair of connectors with the one ends assembled on the guidance grooves on the gap controller and the other ends fixed on the moving plates at the corresponding positions to the guidance grooves of the gap controller; and a guiding mechanism to direct the movement of the moving plates on the base in the direction of the shaft.

10 Claims, 10 Drawing Sheets

SEAT APPARATUS HAVING VARIABLE GAP

TECHNICAL FIELD

The present invention pertains to a seat apparatus with a variable gap and, more particularly, to a seat apparatus with a pair of divided seats and a mechanism to control the gap between the seats in order to adapt to the body shape of a user.

BACKGROUND ART

When a person spends a long period of time on a chair, coccygodinia is likely to occur. Coccygodinia is a pain in the coccyx or tailbone at the end of the lumbar.

Also a person with hemorrhoids has difficulty in maintaining a posture for a long time while sitting.

The utility patent No. 20-0260631, "seat apparatus with a gap" was previously submitted and registered as a device to relieve the pain from people with such symptoms.

In this utility patent, the seat is designed in a way that a user can adjust the gap between a separated set of base units.

Although the gap is adjusted through a gear mechanism attached underneath the seat, this mechanism presents certain inconveniences.

The gap spacing is restricted and can be adjusted by the first and the second fixation holes.

Therefore, the spacing can only be adjusted in steps making minute adjustment not possible.

The user must unlock and relock the mechanism after each adjustment of the space, and must rise from the chair to do that.

DISCLOSURE OF THE INVENTION

This invention was devised in an effort to improve the problems stated in the above section.

The main purpose of this invention is to provide a seat apparatus with a convenient gap control to adjust and maintain the seat at a desired position. The invention can offer a comfortable seating with a soft cushion as well as air ventilation through the gap. The application of the invention can extend to the automobile seats.

To accomplish the above purpose, this invention comprises a pair of seats movable in the opposite directions; a pair of moving plates attached underneath the seats; a base supporting the moving plates for the movement in the opposite direction; a shaft attached on the base to rotate; a truncated cone shaped gap controller attached on the shaft with the guidance groove molded on the narrow end; a motoring device attached to one end of the shaft to rotate; a pair of connectors one ends of which are attached on the guidance grooves of the gap controller, and the other attached on the corresponding positions on the moving plates; and a guidance method to direct the movement of the moving plate along the shaft on the base.

The above motoring device rotates forward and backward to control the gap between the pair of seats by adjusting the moving plates that are attached underneath the seats and linked to a pair of guidance groove through connectors.

The above guiding device consists of many supporting blocks that can slide with their one ends fixed underneath the above moving plates and the other ends assembled to the above shaft.

Or, the above guiding device consists of a pair of roller grooves formed parallel to the shaft over the mentioned base in order to coordinate the trace of the movement with the alignment of the shaft, and many rollers attached underneath the above moving plates to be inserted on and move along the above roller grooves.

The above guiding device consists of rails formed in the front and rear of the above base, and a number of rollers that are fixed on the corresponding locations of the above moving plate to move along the above rail.

In addition, this invention can take the configuration where another seat(s) can be located in the front and/or rear of the above base.

This invention consists of the above pair of seats, hinge units located outside each ends of the above moving plates to form hinge joints, and buffering devices attached between the above seats and the moving plates.

The above buffering device consists of a leaf spring or a coil spring.

This invention provides a pair of seats that can move independently in opposite directions; a pair of moving plates attached beneath the seats that can move independently in opposite directions; a base supporting the pair of moving plates to move independently in opposite directions; two shafts installed on the upper side of the base that can rotate; two truncated cone shaped gap controllers with guidance grooves, one being attached in the middle of each of the shafts; two motoring devices, one being attached at one end of each respective shaft to rotate them; two pair of connectors, each connector with one end received within a guidance groove on the respective gap controller and the other end fixed on the respective moving plate at a position corresponding to the respective location of the guidance groove on the respective gap controller.

This invention also provides a seat apparatus with a variable gap that can be controlled by two guiding devices that guides the movement of the above two moving plates parallel to the shaft on the base.

The above two guiding devices consists of either many supporting blocks with its one ends attached to the shafts to slide and the upper section fixed to the above moving plates, or many rollers attached beneath the moving plates that are inserted into the roller grooves formed parallel to the direction of the shaft on the upper surface of the base in order to maintain the line of movements corresponding to the direction of the shaft.

BEST MODE FOR CARRYING OUT THE INVENTION

The following describes the preferred embodiment with appended illustrations.

Figure 1:
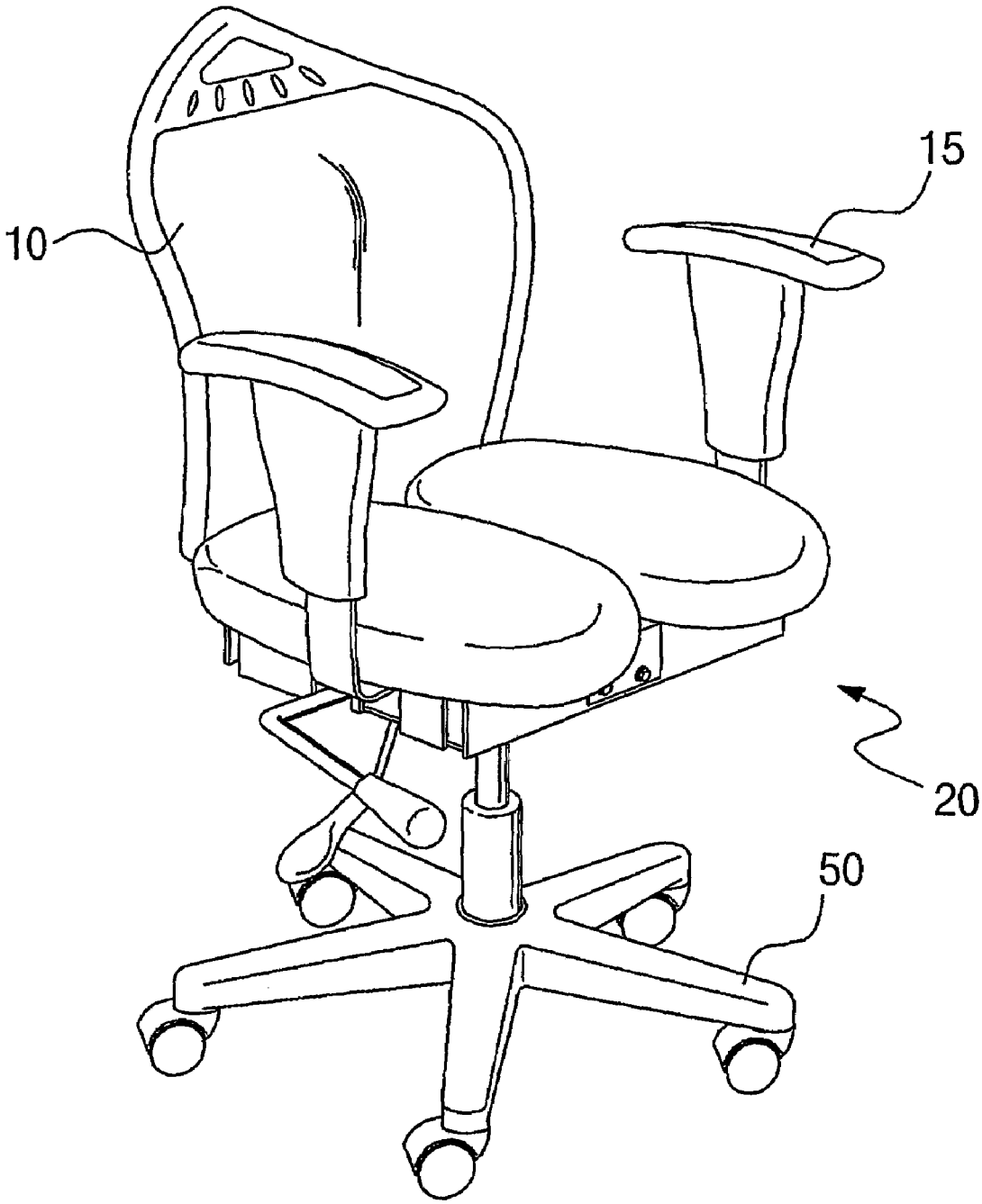
FIG. 1 is a perspective view of a chair made in accordance with the concepts of the present invention.

As illustrated in FIG. 1, an example of a general chair with back (10) and base (50) is used to explain the embodiment of the seat apparatus with a variable gap according to this invention.

Therefore, the concept of this invention is also applicable to a chair with or without the above back (10), armrest (15) or any other parts depending on the purpose and environment.

Figure 4:
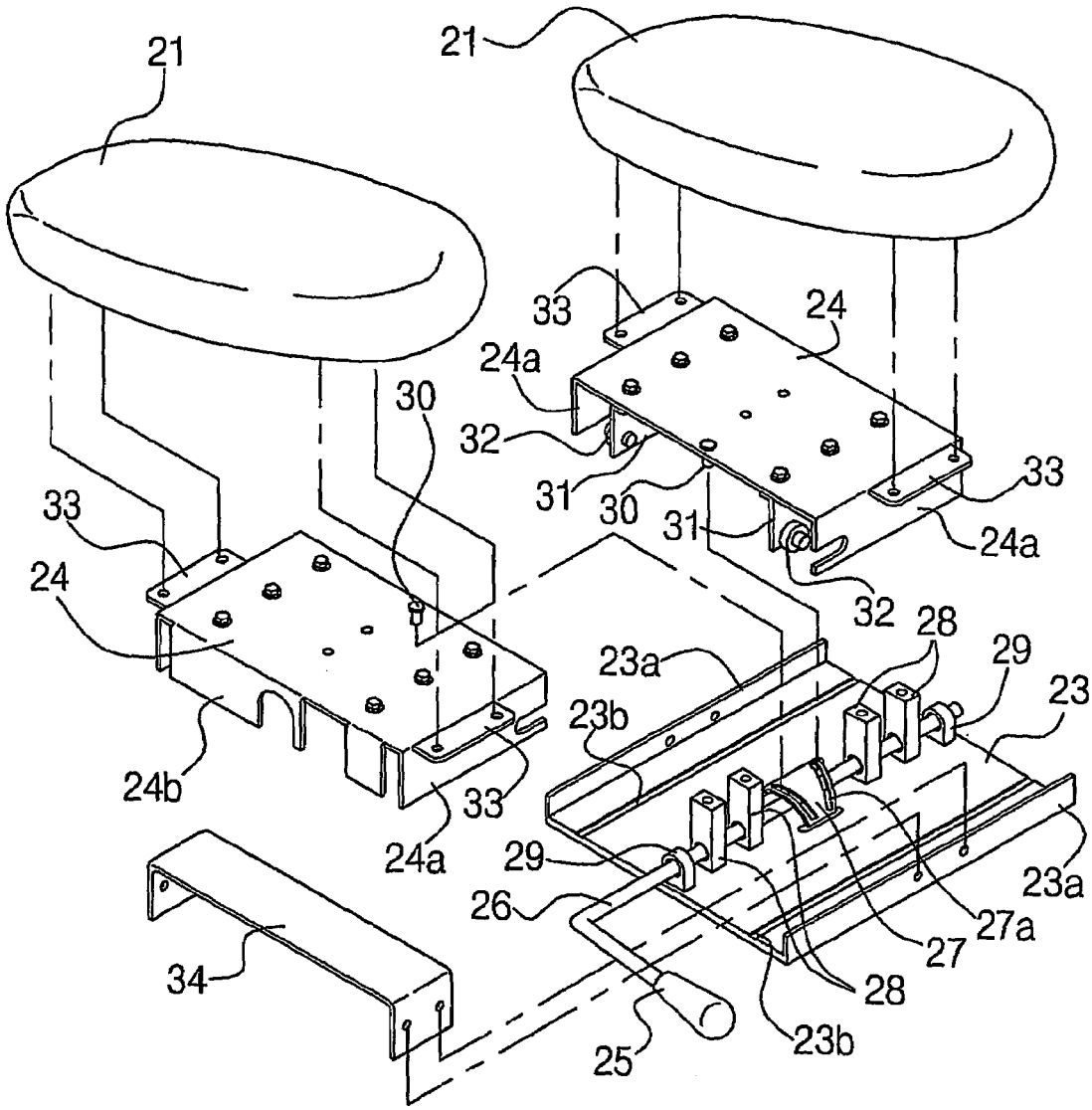
FIG. 4 is an exploded perspective view to illustrate the structure of the seat.
Figure 5:
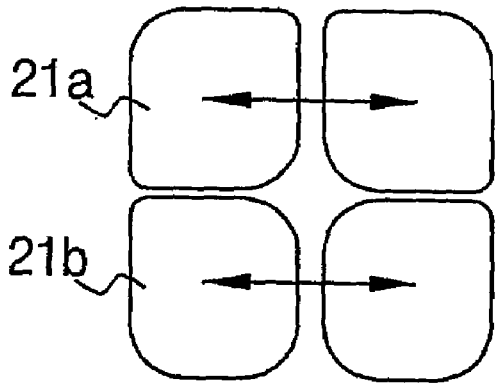
FIGS. 5 and 6 are top plan views to illustrate other possible application of the concept.

As illustrated in the FIG. 4, the chair in accordance with this invention has a seat unit (20) comprised of a pair of seats (21) that can move horizontally enabling a user to adjust the gap between the seats (21).

The above pair of seats (21) is assembled on a pair of moving plates (24). To attach the seats, in the front and rear of the above moving plates (24), Fixation plates (33) are molded on the moving plates to hold the seats by bolting through many holes on the fixation plates.

In the inner center of each moving plate (24), there is a connector (30) having one end received within a guidance groove (27*a*) on the gap controller (27).

In addition, underneath the moving plates (24), there is a pair of supporting plates (31) attached in the front and the rear.

On each outer side of the supporting plate, there are two rollers (32) attached, which are inserted into and moving along a pair of roller grooves (23*b*) that elongate sideways in the inner side of the base (23).

The rollers (32) support the moving plates (24) and prevent their bending into the base (23) during the movement, in addition to guiding the linear movement of the plates along the roller grooves (23*b*).

The structure of the moving plates (24) assembled with the base (23) through the supporting plate (31) and the roller (32) creates an open space. To prevent the foreign substances entering into the assembly, plate 1 (24*a*) blocks the front and the rear, and plate 2 (24*b*) blocks the side.

The base (23) enables the linear movement of the moving plates (24) in both ways. In the front and the rear of the base, there are plate 3 (23*a*) isolating the space within the assembly with plate 1 (24*a*) and the covering plate (34) is attached on the middle of the base to block the opening created when moving plates (24) are widened.

In the middle of the base (23) a pair of shaft supports (29) is installed at each edge of the base. The shaft support enables the rotation of the shaft (26).

In the middle of the shaft (26), the connector (30) is coupled to the gap controller (27) through the guidance groove (27*a*). The gap controller (27) is arcuate in shape with the narrow front and a wider back.

Therefore, the width between the guidance grooves (27*a*) on the gap controller (27) is also narrow in the front and wide in the back.

Figure 2A:
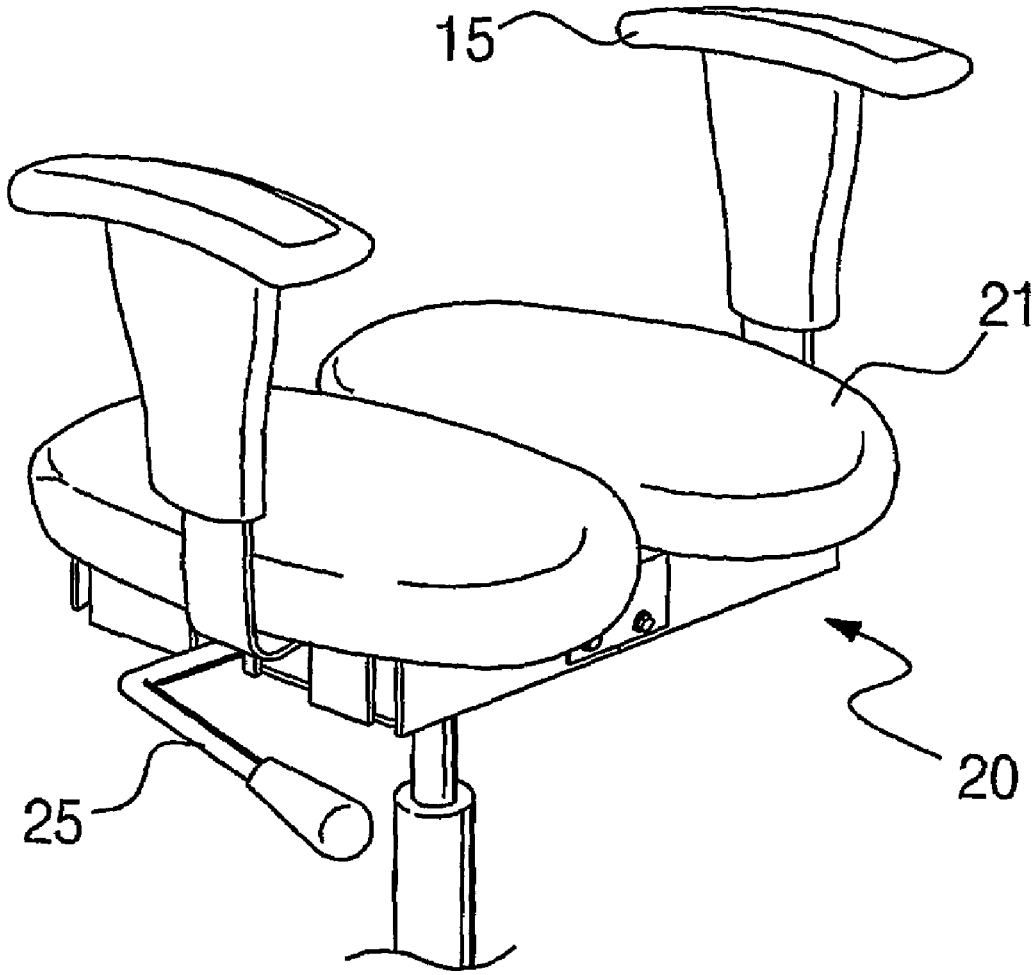
FIG. 2*a*~FIG. 2*c* are plans to illustrate the seats in the narrow configuration.
Figure 2B:
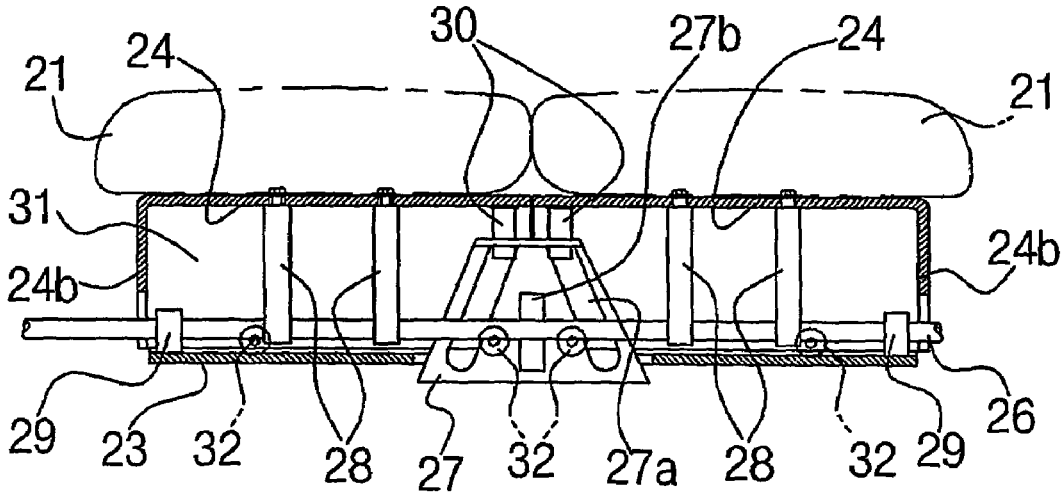
Figure 2C:
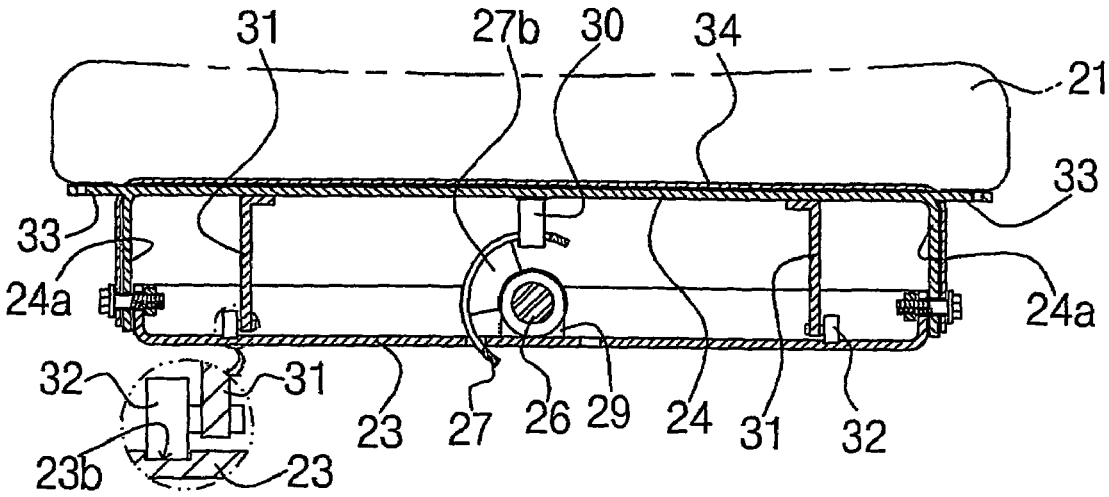
Figure 3A:
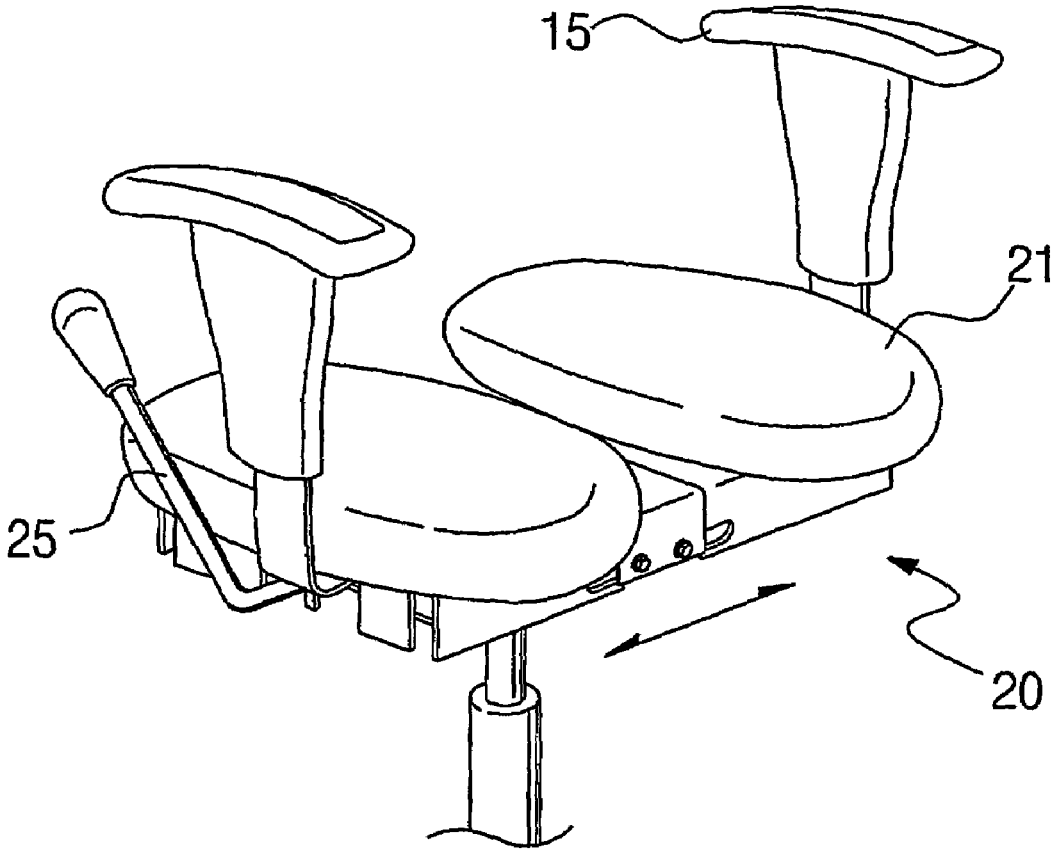
FIG. 3*a*~FIG. 3*c* are plans to illustrate the seats in the wide configuration.
Figure 3B:
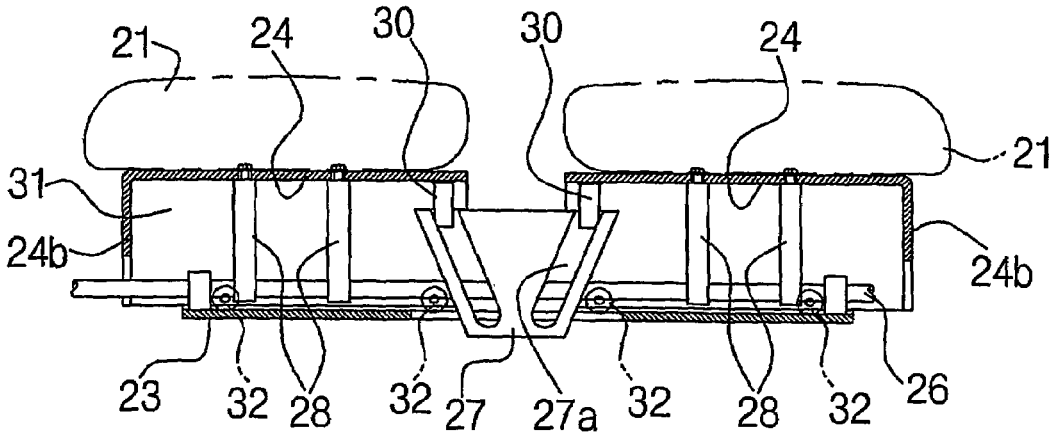
Figure 3C:
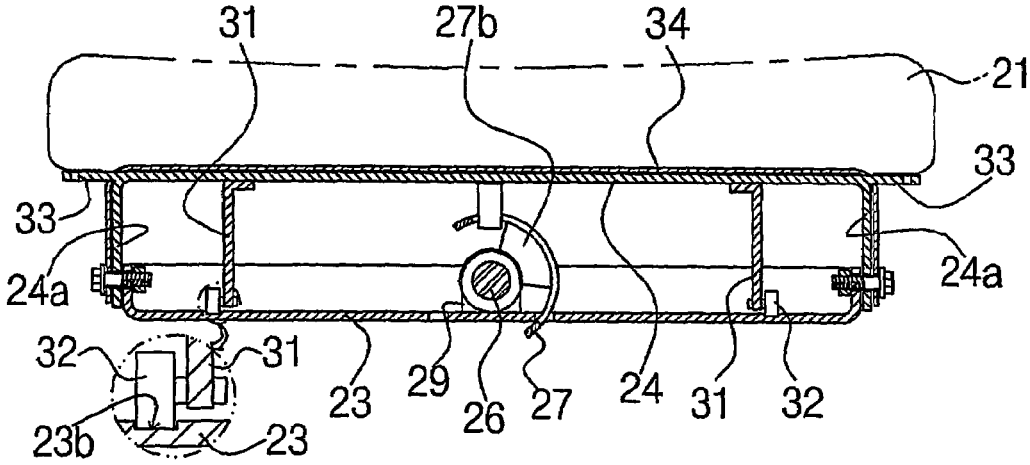

And the gap controller (27) is fixed and assembled on the shaft (26) through the extender (27*b*) forming a concentric circle with the shaft in the middle as illustrated in FIG. 2*c* and FIG. 3*c*.

Many supporting blocks (28), two on each plate in this example, that can slide are attached on the shaft (26) to give a support to the center of the moving plate (24) and guide the linear movement by sliding along the shaft (26). For that reason, the height of the supporting blocks (28) needs to be equal to the height of the inner side of the moving plate (24).

With the connectors (30) on the moving plates (24) assembled on the guidance grooves (27*a*) of the gap controller (27), the shaft (26) and the gap controller (27) rotate together when the lever (25) is pulled up. Therefore, the gap width of the connectors (30) assembled on the guidance grooves (27*a*) change with the rotational angle of the gap controller (27).

When the connector (30) is moved to the end of the guidance groove (27*a*) on the narrow end of gap controller (27), the width of the gap between the seats is the shortest. Therefore, the moving plates (24) are at the closest position to each other and the seats (21) are adjacent to each other (Refer to FIGS. 2*a*-2*c*).

On the other hand, when the connector (30) is moved to the end of the guidance groove (27*a*) on the wide end of gap controller (27), the width of the gap is the longest and the gap between the seats is at its maximum (FIGS. 3*a*-3*c*).

Therefore, the user can adjust the lever (25) to rotate the shaft (26) to adjust the gap between the seats (21) and leave the lever (25) to maintain the gap between the seats (21).

Although a lever (25) was used as a motoring device to rotate the shaft (26) in this example, an electronic motor can be used as well.

In this example, the gap control through the guidance groove (27*a*) on the gap controller (27) is from 0 to 25 mm on each side (0-50 mm in total) but the gap could be set to be controlled in a longer or shorter range.

The assembling procedure of this invention is explained with FIG. 4.

Attach the supporting blocks (28) on the shaft (26) and fix the shaft on the center of the upper side of the base (23) using a shaft support (29). Here, a lever (25) is attached at one end of the shaft (26).

Insert the connector (30) fixed in the inner center of the moving plates (24) into the guidance groove (27*a*) on the gap controller (27). Fix the upper side of the supporting blocks (28) on the moving plates (24) by bolting through the holes.

When the moving plate (24) is assembled as the above, roller (32) is inserted in the roller groove (23*b*) as illustrated in FIG. 2*c* or FIG. 3*c*.

With the moving plates (24) assembled on the base (23), bolt the covering plate (34) on the front and back of the base (23).

Attach the seats (21) on the fixation plates of the moving plates (24) by bolting.

After finishing the above assembly, attach the upper section of the base wheels (50) in the middle of the bottom of the base (23), attach the lower section of the armrest (23), and attach the lower section of the back (10) at the back of the base (23). When assembling the armrests (15) on the base (23), a proper distance for the movement of the moving plates (15) must be allowed.

The above embodiment of the invention used a general chair as an example. However, some of the components such as the back (10), the base wheels (50), and the armrest (15) can be excluded and the seat unit (20) can comprise the seat for automobiles with the back designed for automobiles.

That is, to apply the seat unit (20) for the automobile seats, a separate locking mechanism to slide the seat unit (20) along the seat rail on the automobile can be attached under the base (20).

In addition, it is possible to install the ventilation unit and the ventilation duct in the middle of the seats (21) after removing the covering plate (34) to provide a comfortable driving environment.

Although the above embodiment of the invention used the seats separated in two, it is possible to construct a seat base of four separate seats and have each pairs (21*a*, 21*b*) controlled by separate gap controllers.

For the above configuration, two sets of components including moving plates, supporting plates, rollers, shafts, levers, gap controllers, supporting blocks, and roller grooves are necessary to match with a pair of seats (21*a*, 21*b*) as in the example illustrated in the FIG. 1-4.

Figure 6:
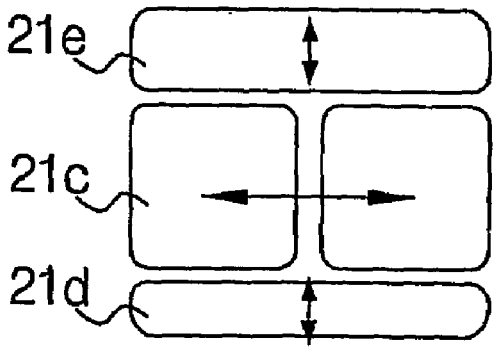

Moreover, it is also possible to place an anterior seat (21*d*) and a posterior seat (21*e*) in addition to the pair of seats (21*c*) as in the FIG. 6.

In the example of FIG. 6, it is not necessary to move the anterior seat (21*d*) and the posterior seat (21*e*) at the same time. Therefore, each seat has independent moving mechanism.

An adequate method is to adopt a sliding mechanism to move the moving plate with the anterior seat (21*d*) and the posterior seat (21*e*) attached over the base.

To construct a seat as in the FIG. 6, a structure for moving the base back and forth in addition to the mechanism for horizontal movement is necessary.

When the anterior seat (21*d*) and the posterior seat (21*e*) are not to move, it is sufficient to provide brackets to hold the seats in the front and the back of the base.

Descriptions for the examples in FIG. 1 or FIG. 6 were for the seat unit with two or four seats on the moving plates.

In addition to the examples, this invention also includes the mechanism to provide a shock absorb on the seats (90) against the moving plates (75).

In this example, sliding method of the moving plates (75) on the base (70) is also different. The concept of the invention is explained with the illustrations on FIG. 7 and FIG. 8.

As the previous examples, the base (70) is attached on the base wheels (50) as shown in FIG. 1.

Rails (71) are formed on the front and the back of the base (70) and are bended perpendicularly.

As in the previous examples of embodiment (FIGS. 1-6), many shaft supports are formed in the middle and the shaft (80) is installed on the shaft supports (72).

In the middle of the shaft (80), a gap controller (81) that moves the seat (90) horizontally is installed. The gap controller (81) has the same structure as the gap controller (27) described in the previous examples (FIGS. 1-6).

A pair of moving plates (75) is attached on the base (70), and a pair of rollers (74) is installed inside each moving plate (75) in the front and the back.

The rollers can rotate and moves along the rails (71) formed in the front and the back of the base (70).

At the upper side of the gap controller (81) where two moving plates (75) are facing each other, a connector that is inserted in the guidance groove of the gap controller (81) is fixed and assembled. To prevent foreign substances from entering the inner space between the base (70) and the moving plates (75), a covering plate (95) is installed keeping a certain distance with a special care not to interfere with the movement of the moving plates (75).

To prevent the moving plates (75) from bending due to the weight of a user, supporting blocks (73) are installed inside each moving plate (75), where the supporting blocks are installed in a way that slide along the shaft (80).

The previous examples of embodiment (FIGS. 1-6) were to illustrate the case where the seats are fixed on the moving plates. From such configuration, a shock absorbing can be accomplished only through the materials used for the seats. Therefore, this invention supplements the shock absorbance of the seats (90).

Figure 7:
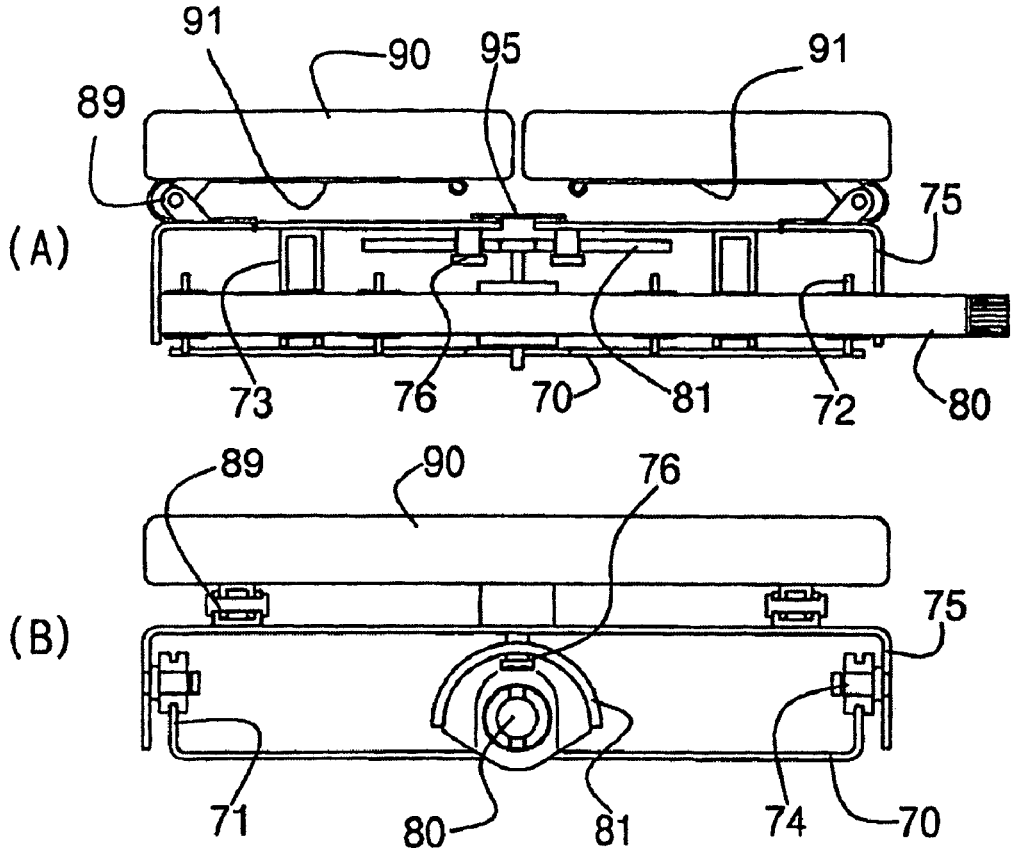
FIG. 7 is a front plan view and a side plan view to illustrate another way to apply the mechanism of the invention.

As illustrated in FIG. 7, the seat (90) and the moving plate (75) is hinged by hinge (89) under one end of the seat (90) and above one end of the moving plate (75) and a shock absorbing device is installed.

Figure 8:
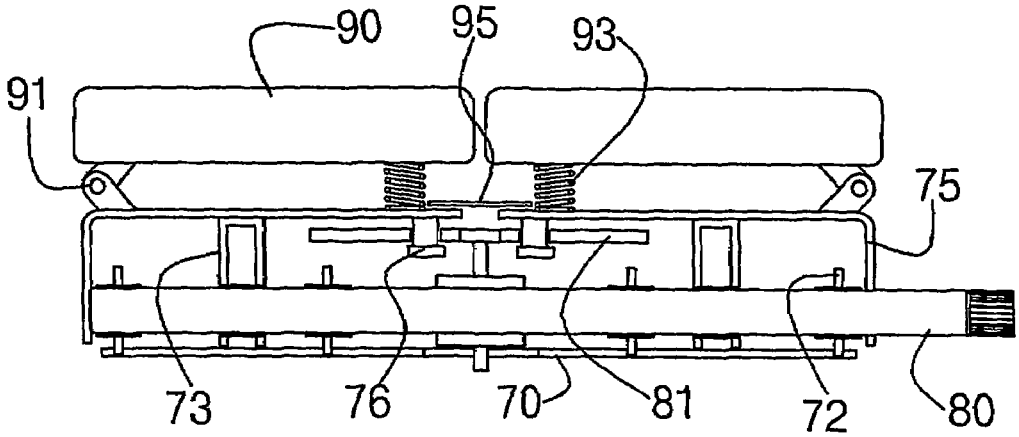
FIG. 8 is a front plan view of yet another application of the mechanism of the invention.

In FIG. 7, leaf spring (91) is used for the shock absorbing device and coil spring (93) is used in FIG. 8.

As the middle of the seat unit is lowered and absorbs the shock when a user sits on the chair and the seats (90) are adjusted to fit the pelvic and femoral region, the user can maintain more comfortable posture.

Figure 9:
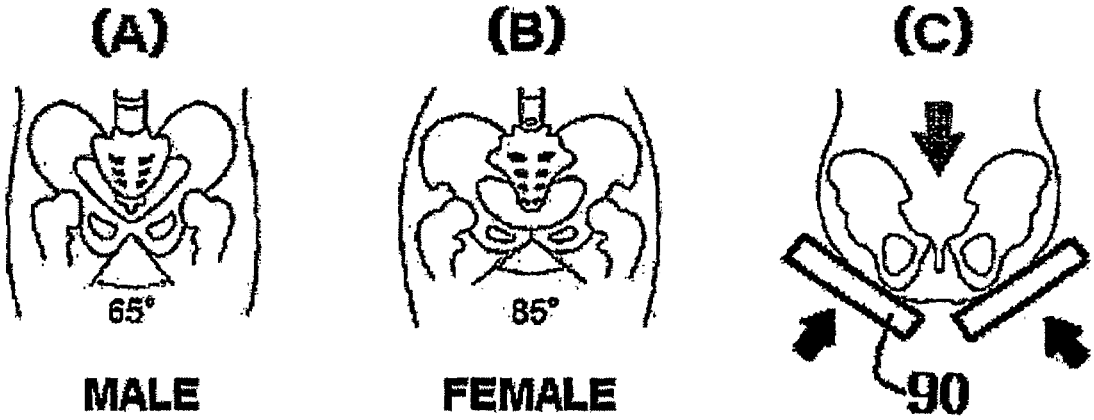
FIG. 9 is a figure to illustrate the efficacy of the present invention.

The pelvic angle is different for men (65') and women (85') as illustrated in FIGS. 9 (A) and (B).

The pelvic angle can get wide due to improper posture, giving birth etc.

The larger pelvic angle causes the expansion of the pelvic gap. Since pelvis supports the weight of an upper body, the expansion of the pelvic gap leads to the increase of flesh around the bone and causes the corpulence of the lower body.

Therefore, this invention helps reducing the gap between the pelvises or prevents the expansion of the gap by lowering the middle of the seats (90) as in FIG. 9(*c*) and corrects the pelvic shape.

While working, people tend to distort the upper body or incline to one side rather than maintaining the proper posture.

This invention changes the angle of the seats with the body movement and spreads the body weight evenly throughout the pelvis as illustrated in FIG. 7, 8.

INDUSTRIAL APPLICABILITY

As described in the above section, this invention divides the seats and allows their horizontal movements.

Such mechanism relieves the pressure on the anal region, provides a comfortable seating experience, makes the horizontal movement easy, and affords fresh environment through ventilation.

In addition, this invention can provide a fresh driving environment when applied on the automobile seats.

The shock absorbing function of the seat adjusts the angle of the seats for the pelvis and provides a user with comfortable working environment.

The examples illustrated only handful cases if possible embodiment of the invention. However, a person with a proper knowledge and skill in the field will be able to apply various modifications and changes within the scope of the invention.

What is claimed is:

1. A seat apparatus having a variable gap comprising:

a pair of seats that can move in opposite directions;

a pair of moving plates each attached under the seats to move in opposite directions;

a base for supporting the moving plates to move in opposite directions;

a shaft rotatably attached on the upper side of the base;

a gap controller attached in the middle of the shaft, having one narrow end and one wide end;

a pair of guidance grooves;

driving means attached on one end of the shaft for rotating the shaft;

a pair of connectors each having one end coupled with the respective guidance groove on the gap controller and the other end fixed on the respective moving plate at the corresponding position to the guidance groove of the gap controller; and guiding means for making the moving plates move along the base, wherein gaps between the pair of seats and the pair of moving plates coupled with the guidance grooves through the pair of connectors is adjusted by rotating the shaft clockwise/counterclockwise with the driving means.

2. The seat apparatus of claim 1, wherein the guiding means comprises a plurality of supporting blocks wherein one end is slidingly fixed underneath the moving plates and the other end is assembled to the shaft.

3. The seat apparatus of claim 1, wherein the guiding means comprises a pair of roller grooves formed parallel to the direction of the shaft on the upper section of the base in order to coordinate the path of movement of the moving plates with the direction of the shaft, and a plurality of rollers attached under the moving plates to be inserted in the roller grooves for the movement.

4. The seat apparatus of claim 1, wherein the guiding means comprises rails formed in the front and the back of the base and a plurality of rotating rollers attached on the moving plates at the corresponding positions to the rail for moving the rails.

5. The seat apparatus of claim 1, further comprising at least one seat either in front or back of the base.

6. The seat apparatus of claim 1, further comprising hinge units disposed on the pair of seats outside each end of the moving plates to form hinge joints, and buffering means attached between the seats and the moving plates.

7. The seat apparatus of claim 6, wherein the buffering means comprises either leaf springs or coil springs.

8. A seat apparatus having a variable gap comprising:

two pairs of seats that can move independently in opposite directions;

two pairs of moving plates attached under the seats that move independently in opposite directions;

a base for supporting the pairs of moving plates to move independently in opposite directions;

two shafts rotatably attached on the upper section of the base;

two gap controllers, one being attached in the middle of each shaft, each gap controller having a pair of guidance grooves, the gap controllers having one narrow end and one wide end;

a driving means attached at one end of each shaft for rotating the shaft;

two pairs of connectors each having one end coupled with a guidance groove on the respective gap controller and the other end attached on the respective moving plate at a position corresponding to the guidance groove of the respective gap controller; and two guiding means that make the moving plates move along the base.

9. The seat apparatus of claim 8, wherein each of two guiding devices comprises a plurality of supporting blocks wherein one end of each is slidingly fixed underneath the moving plates and the other end is assembled to the shaft.

10. The seat apparatus of claim 8, wherein each of two guiding devices comprises a pair of roller grooves formed parallel to the path of movement of each moving plate and a plurality of rollers attached under each moving plate that are inserted in the roller grooves to slide the moving plates over the base.

* * * * *